US006601711B1

(12) United States Patent
Knable, III

(10) Patent No.: US 6,601,711 B1
(45) Date of Patent: Aug. 5, 2003

(54) BALL HOLDER

(76) Inventor: Elmer Knable, III, 3005 Fox Hill Dr., Floyd Knobs, IN (US) 47119

( * ) Notice: Subject to any disclaimer, the term of this patent is extended or adjusted under 35 U.S.C. 154(b) by 0 days.

(21) Appl. No.: 10/143,164

(22) Filed: May 10, 2002

Related U.S. Application Data

(60) Provisional application No. 60/353,969, filed on Jan. 31, 2002.

(51) Int. Cl.[7] ..... A47F 7/00
(52) U.S. Cl. ..... 211/14
(58) Field of Search ..... 211/14, 85.7; 248/690, 248/315; D6/552

(56) References Cited

U.S. PATENT DOCUMENTS

| | | | |
|---|---|---|---|
| 3,368,689 | A | 2/1968 | Porterfield |
| 4,002,241 | A | 1/1977 | Parrilla, Sr. |
| 4,077,514 | A | 3/1978 | Kubokawa |
| D248,342 | S | 7/1978 | Young |
| D248,809 | S | 8/1978 | Kailey |
| 4,214,684 | A | 7/1980 | Golowitz |
| 4,256,244 | A | 3/1981 | Gasper |
| D282,704 | S | 2/1986 | Burnett |
| D333,214 | S | 2/1993 | Stewart, Jr. et al. |
| 5,186,374 | A | 2/1993 | Buxton |
| 5,232,101 | A | 8/1993 | Shaftner et al. |
| 5,386,906 | A | 2/1995 | Lai |
| D375,406 | S | 11/1996 | Smith |
| D394,154 | S | 5/1998 | Smith |
| 5,855,286 | A | 1/1999 | Zaid |
| 5,894,951 | A | 4/1999 | Hunt |
| 5,988,433 | A | 11/1999 | Crum |
| D419,632 | S | 1/2000 | Ashcroft |
| 6,158,593 | A | 12/2000 | Olsen |
| 6,267,461 | B1 | 7/2001 | Dunagan et al. |
| 6,454,105 | B1 * | 9/2002 | Medina ..... 211/14 |

OTHER PUBLICATIONS

Sky Mall.com–Continental Airlines Catalogue "Basketball Bin" Jan. 14, 2002.

* cited by examiner

*Primary Examiner*—Alvin Chin-Shue
*Assistant Examiner*—Sarah Purol
(74) *Attorney, Agent, or Firm*—Camoriano ans Associates; Theresa Fritz Camoriano

(57) ABSTRACT

A ball holder for supporting a ball includes a hoop portion and a bracket portion. A preferred embodiment includes means for supporting a football, means for mounting to various support surfaces, means for supporting an air pump, and means for storing needle valves.

21 Claims, 7 Drawing Sheets

BALL HOLDER

BACKGROUND

This application claims priority from U.S. Provisional Application Ser. No. 60/353,969, filed Jan. 31, 2002. The present invention relates to devices for holding balls, and, in particular, to a hoop adapted to be mounted in a substantially horizontal orientation to support a ball.

SUMMARY

In a preferred embodiment, the inside diameter of the hoop is less than the diameter of a standard volleyball, soccer ball, and basketball, so that the same hoop can receive and support any of those balls. Also, in a preferred embodiment, the hoop defines opposed depressions which also make it adapted to receive and support a football. Also, in a preferred embodiment, the ball holder includes an integral bracket which includes a mounting arrangement adapted to mount onto a pole having a circular cross-section, onto a pole having a square cross-section, and onto a flat wall or large pole having a flat surface. Also, in a preferred embodiment, the ball holder has an elongated, arcuate cross-section depression for retaining an air pump as well as defining holes for holding the needle valves that are used with the pump to inflate the balls.

DESCRIPTION OF THE PREFERRED EMBODIMENT

FIGS. 1–8 show one example of a ball holder 10 made in accordance with the present invention. The ball holder 10 includes a hoop portion 12 and a bracket portion 14.

Figure 3:
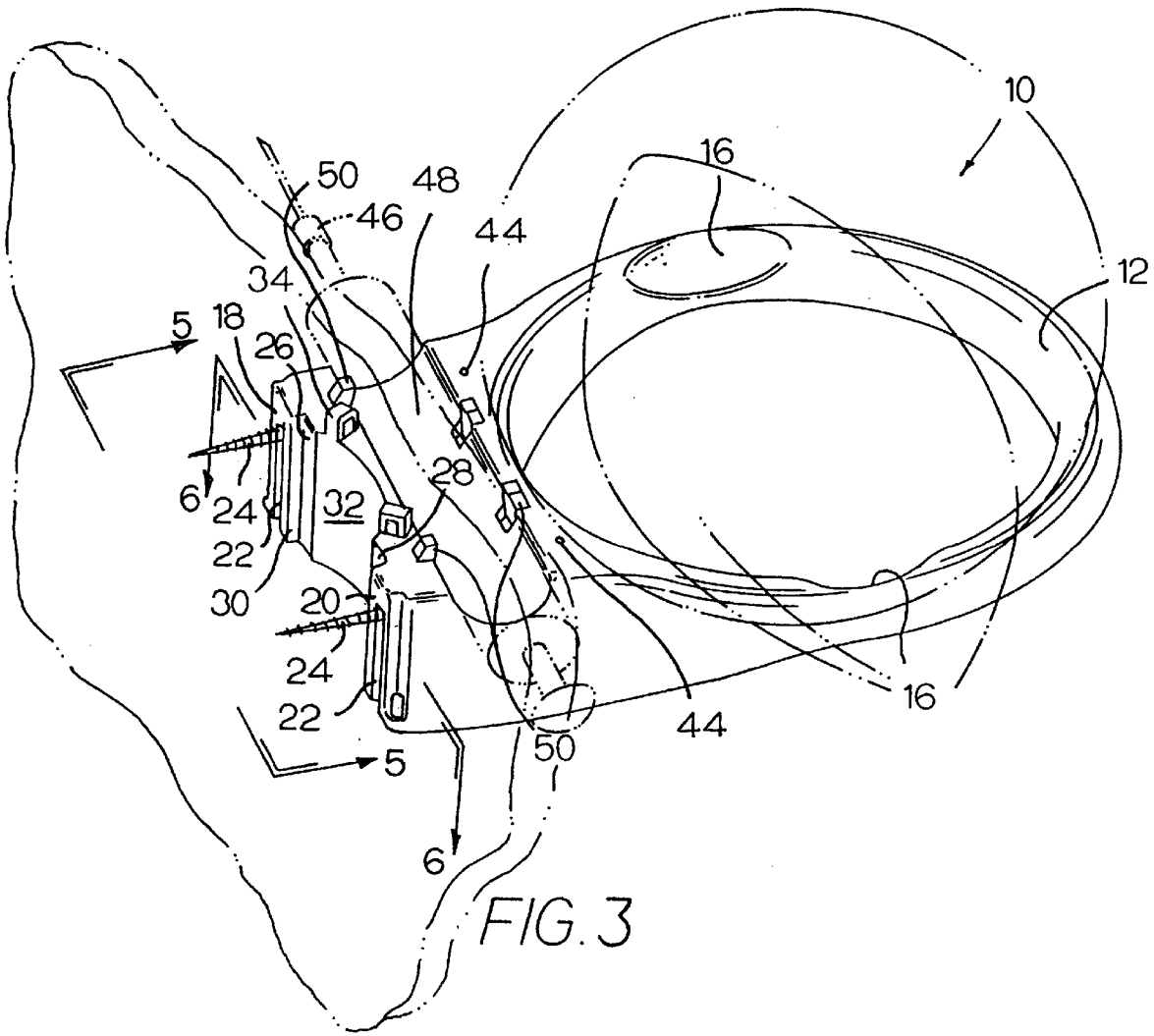
FIG. 3 is a perspective view of the ball holder of FIG. 1, with balls shown in phantom, a wall shown in phantom, and an air pump shown in phantom.
Figure 4:
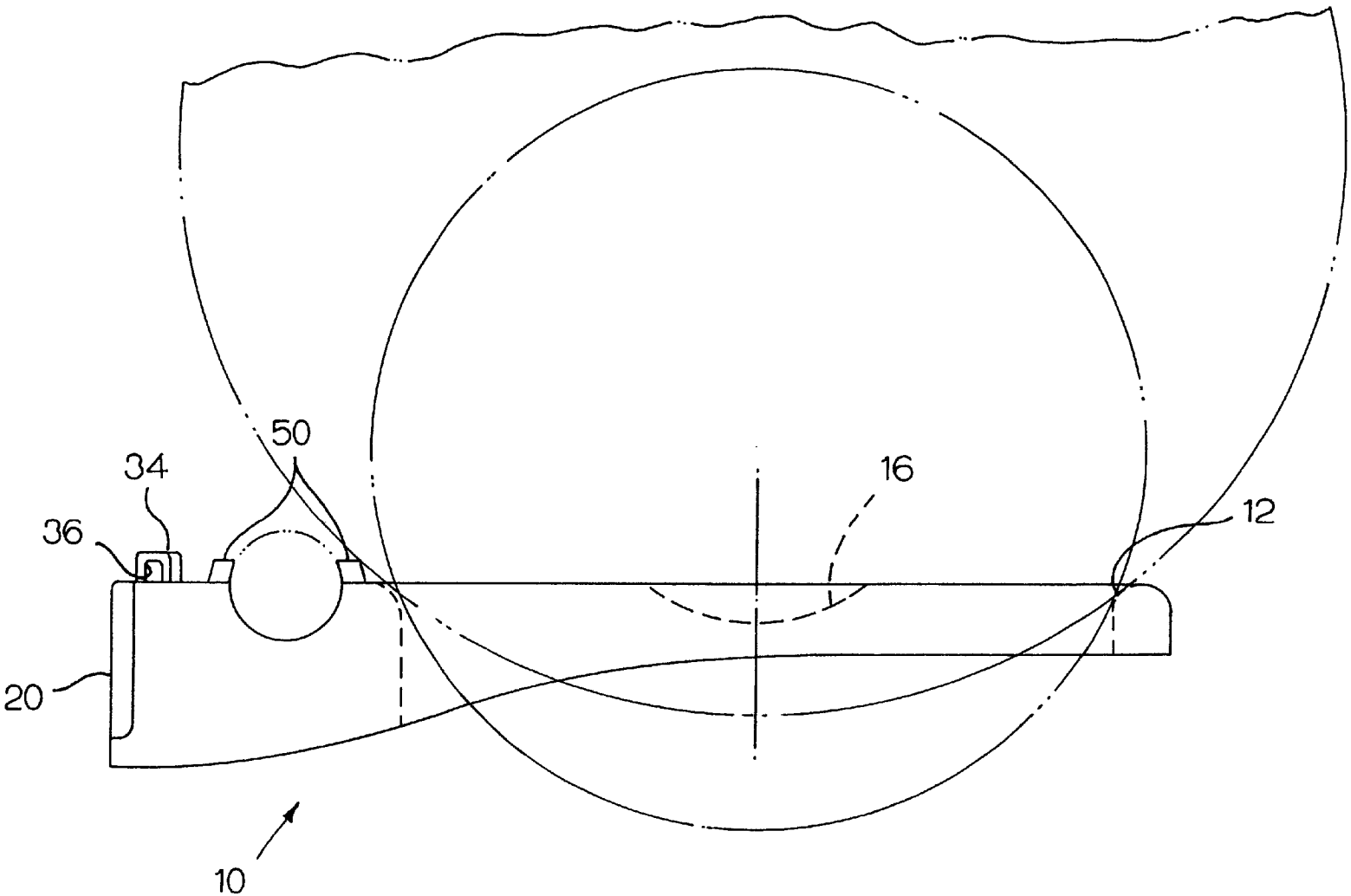
FIG. 4 is a side view of the ball holder of FIG. 1, with two sizes of balls and an air pump shown in phantom.
Figure 5:
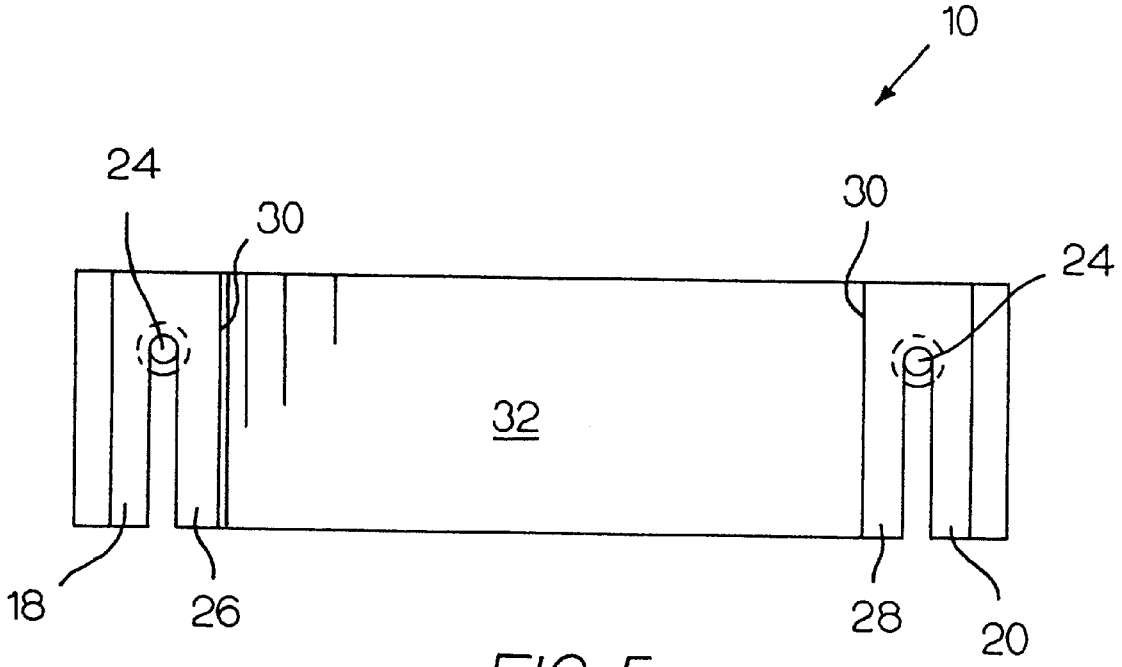
FIG. 5 is a view taken along the line 5—5 of FIG. 3.

The hoop portion 12 has a substantially circular opening, which preferably has a smaller diameter than a volleyball, soccer ball or a basketball, thereby permitting any of those balls to extend partially into the circular opening and to be supported by the hoop, as shown in FIG. 4. The top surface of the hoop portion 12 defines first and second diametrically opposed, tapered depressions 16, which permit a football to. be supported horizontally on the top surface of the hoop portion 12 as shown in FIG. 3. The diameter of the hoop opening preferably is larger than the diameter of a standard football, in order for the soccer ball or basketball to be seated far enough down to be well-supported by the hoop, and it is for that reason that the football is supported horizontally on the tapered depressions 16. Alternatively, if the diameter of the hoop opening were small enough, the football could be supported vertically in the hoop.

Figure 6:
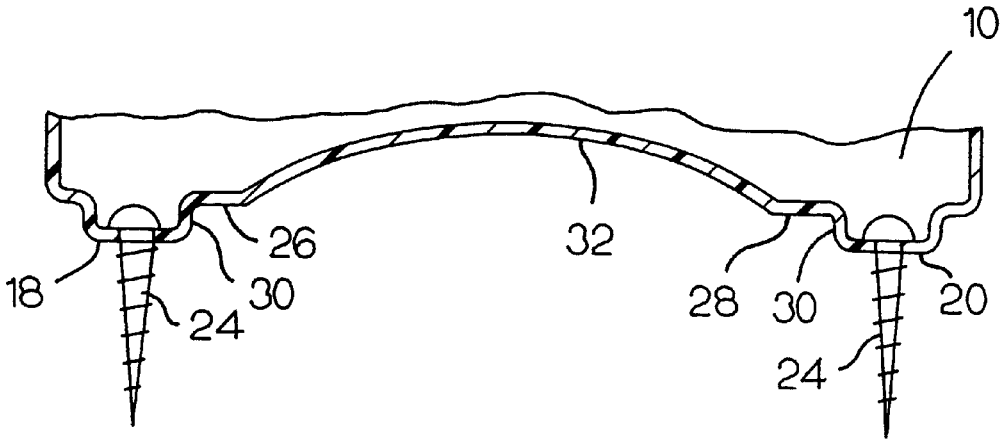
FIG. 6 is a view taken along the line 6—6 of FIG. 3.

The bracket portion 14 projects rearwardly from the hoop portion 12. This bracket portion 14 is designed to permit the ball holder 10 to be mounted on a large flat surface, such as a wall or large post, or on a circular cross-section post, or on a rectangular cross-section post. The portion of the bracket 14 that projects rearwardly the greatest distance includes first and second flat portions 18, 20, each of which defines a vertical slot 22, which is open at the bottom and closed at the top. These first and second flat portions 18, 20 can be used to mount the ball holder 10 to a wall or other large, flat surface, as shown in phantom in FIG. 3. Screws 24 or other fasteners are secured to the wall at the proper height and separated by a distance corresponding to the distance between the slots 22, and the bracket 14 can then be slid down over the screws 24, until the top of the slots 22 hit the screws 24, as shown in FIGS. 3 and 6.

Figure 8:
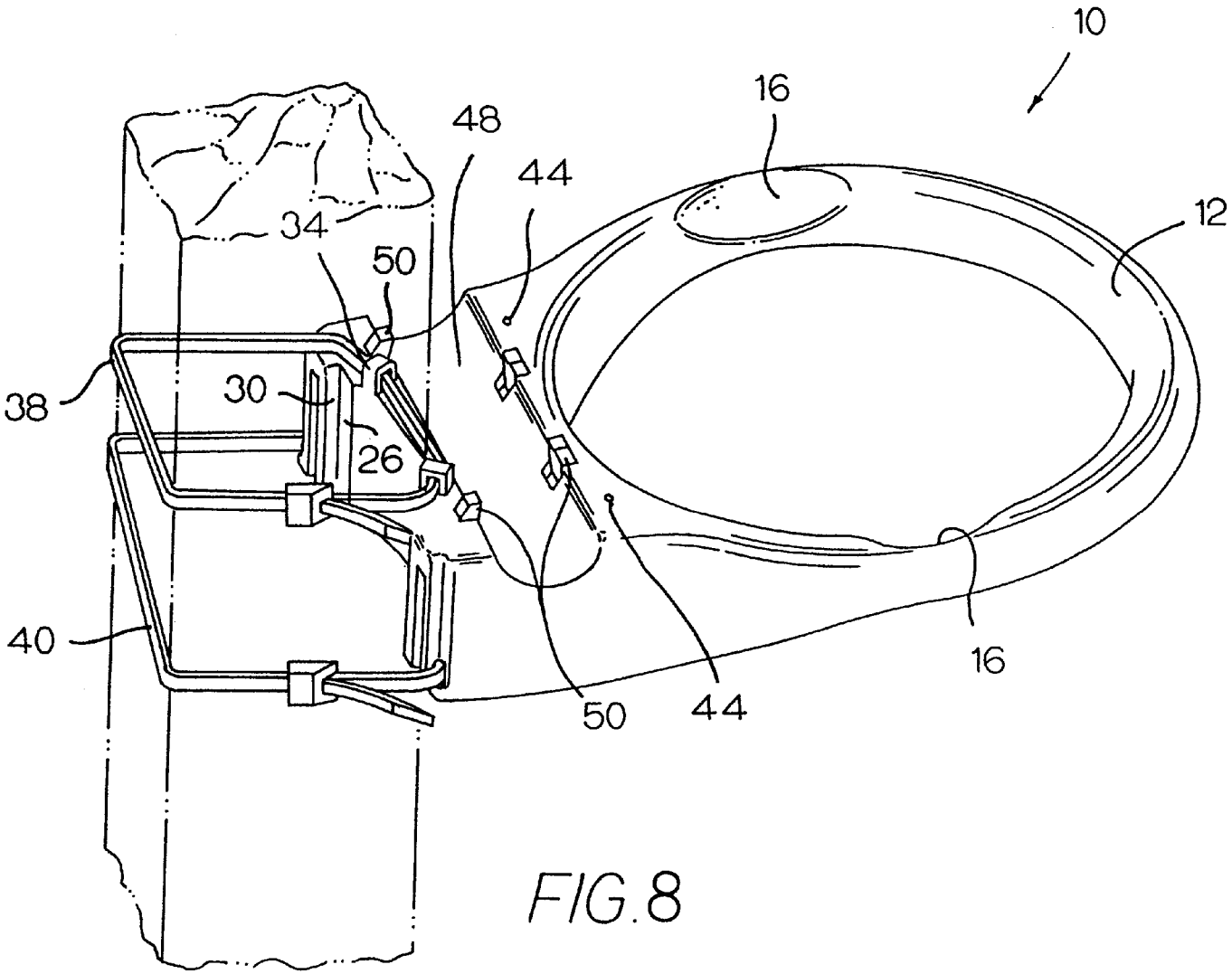
FIG. 8 is the same view as FIG. 7 but with a square cross-section post.

The rear surface of the bracket 14 also defines first and second recessed flat portions 26, 28, recessed from said first and second flat portions 18, 20. Side walls 30 extend from said first and second flat portions 18, 20 to said first and second recessed flat portions 26, 28, and the side walls 30 preferably are spaced apart approximately four inches in order to permit the bracket to fit onto the front and to wrap around a portion of the sides of a four-inch square cross-section post, as shown in FIG. 8.

Figure 7:
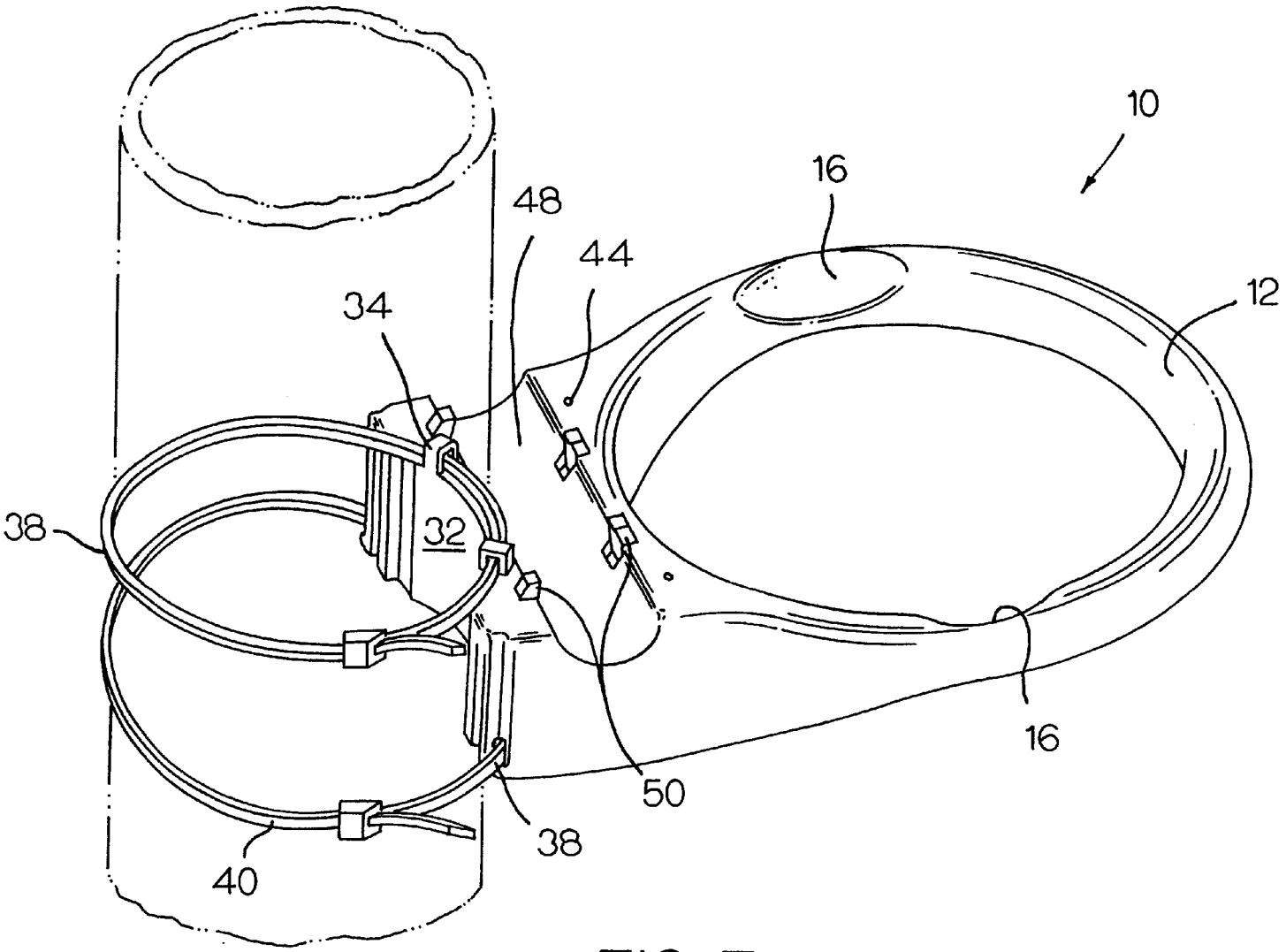
FIG. 7 is a perspective view of the ball holder of FIG. 1 including mounting ties for mounting the ball holder onto a circular cross-section post, shown in phantom.

The rear surface of the bracket 14 also defines an arcuate recessed portion 32, which permits the bracket 14 to wrap partially around a circular cross-section post, as shown in FIG. 7.

The bracket portion 14 also has first and second upwardly-projecting ears 34, which define first and second openings 36 at a first elevation, for receiving a first strap 38 for securing the bracket 14 to a post. It also defines third and fourth openings 38 at a second elevation, for receiving a second strap 40 to secure the bracket 14 to a post. Only one of the openings 38 is shown clearly, but it is understood that the ball holder 10 is symmetrical, so the other opening 38 is a mirror image of the opening 38 that is shown. The straps 38, 40 shown in FIGS. 7 and 8 are well-known plastic straps that can simply be pulled tight and automatically lock in position. Alternatively, a metal pipe clamp or other type of strap could be used. It is anticipated that a plurality of straps 38, 40 will be supplied with the ball holder 10 when it is sold, and two of the straps 38,40 will be threaded through the appropriate openings 36, 38 wrapped around the post, and tightened in place in order to mount the ball holder 10 to a post.

Figure 1:
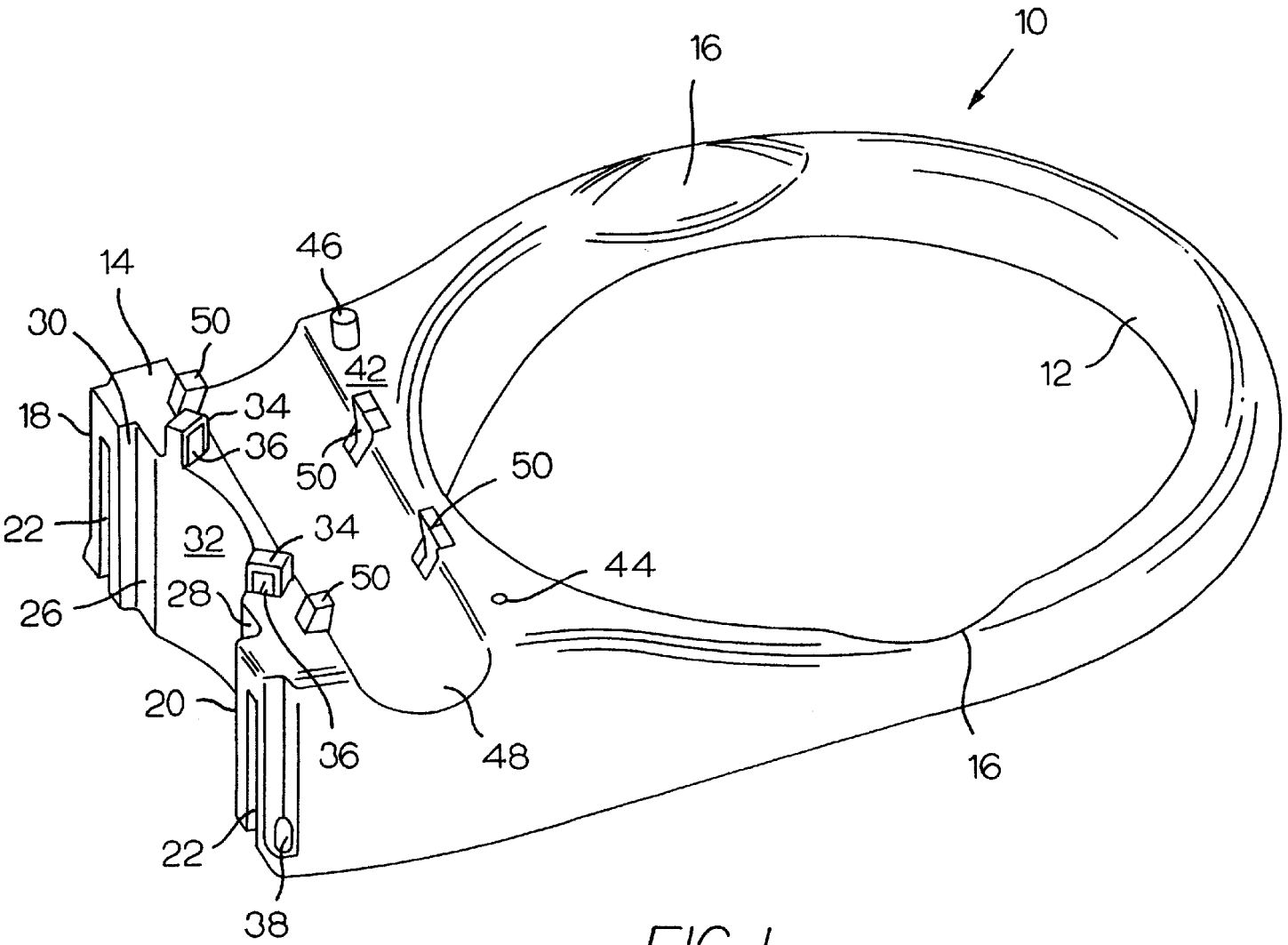
FIG. 1 is a top perspective view of an example of a ball holder made in accordance with the present invention.

The bracket portion 14 also defines a top surface 42, which defines two small diameter holes 44, for receiving a needle valve 46, as shown in FIG. 1. The needle portion of the needle valve 46 extends through the hole 44, and the remainder of the needle valve 46 rests on the top surface 42. The top surface 42 also defines an elongated recess 48 having an arcuate cross-section, for receiving an air pump horizontally, as shown in FIG. 3. In this particular embodiment, upwardly-projecting ears 50 extend the arcuate cross-sectional shape of the recess 48, so as to wrap greater than 180°, or more than half-way around the air pump, in order to secure it in the recess 48. If the ears 50 are flexible enough, the air pump may be inserted down vertically, spreading the ears 50 apart and then allowing them to snap back into position to retain the air pump. Alternatively, if the ears 50 are not very flexible, the air pump may be slid lengthwise into the recess 48.

Figure 2:
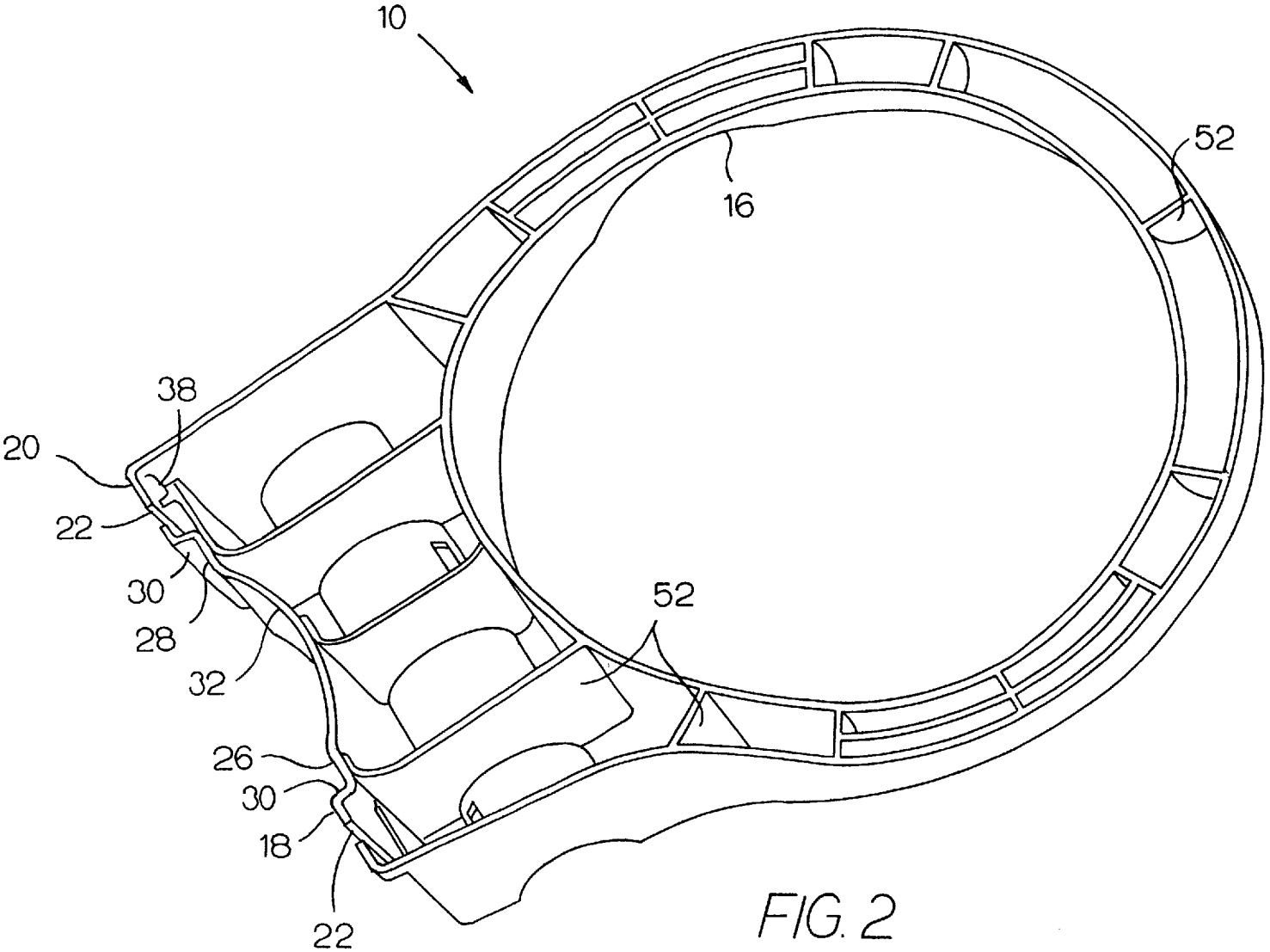
FIG. 2 is a bottom perspective view of the ball holder of FIG. 1.

In the embodiment shown in these drawings, the bracket portion 14 and the hoop portion 12 are molded as a single piece. FIG. 2 shows ribs 52 that are molded into the ball holder 10 to provide strength and support. While the single piece design is preferred, it will be obvious that various portions of the ball holder 10 could be made as individual pieces that are later fastened together.

It will be obvious to those skilled in the art that the embodiment described above is only one example of a ball holder made in accordance with the present invention. Many modifications may be made to the embodiment described above without departing from the scope of the invention as defined by the claims.

What is claimed is:

1. A ball holder, comprising:

a hoop portion; and a bracket portion for fastening said hoop in a substantially horizontal position, said bracket portion having a rear mounting surface, which defines:

first and second flat areas for mounting said bracket to a flat surface;

first and second recessed flat areas, recessed from said first and second flat areas, for mounting said bracket to a rectangular cross-section post; and an arcuate recess, recessed from said recessed flat areas, for mounting said bracket to a circular cross-section post.

2. A ball holder as recited in claim 1, wherein said bracket further defines first and second openings at a first elevation for receiving a strap to secure said bracket to a post.

3. A ball holder as recited in claim 2, wherein said bracket further defines third and fourth openings at a second elevation for receiving a second strap to secure said bracket to a post.

4. A ball holder as recited in claim 3, wherein said hoop and bracket portions are molded together as a single, integral piece.

5. A ball holder as recited in claim 1, wherein said hoop has a top surface which defines first and second diametrically opposed, tapered recesses for receiving a football.

6. A ball holder as recited in claim 1, wherein said bracket portion has a top surface defining an elongated recess having an arcuate cross-sectional shape for receiving an air pump.

7. A ball holder as recited in claim 6, wherein the top surface of said bracket portion further defines at least one small diameter opening for receiving a needle valve.

8. A ball holder as recited in claim 4, wherein said hoop has a top surface which defines first and second diametrically opposed recesses for receiving a football, and wherein said bracket portion has a top surface defining an elongated, arcuate cross-section recess for receiving an air pump.

9. A ball holder, comprising:

a hoop portion, defining a substantially circular opening for supporting a spherical ball, and having a top surface defining diametrically opposed recesses for receiving a football; and a bracket portion for mounting said hoop portion onto a support.

10. A ball holder as recited in claim 9, wherein said bracket portion has a rearwardly-projecting surface, defining:

first and second flat surface portions, each defining a slot, for mounting said ball holder to a flat surface;

first and second recessed flat surface portions, recessed from said first and second flat surface portions, respectively, for mounting to a rectangular cross-section pole; and an arcuate surface portion recessed from said first and second recessed flat surface portions, respectively, for mounting to a circular cross-section pole.

11. A ball holder as recited in claim 10, and further comprising first and second openings in said bracket at a first elevation for receiving a first strap to secure said bracket portion to a post; and third and fourth openings in said bracket at a second elevation for receiving a second strap to secure said bracket portion to a post.

12. A ball holder as recited in claim 11, wherein said bracket portion has a top surface defining a recess for receiving an air pump.

13. A ball holder as recited in claim 12, wherein said top surface of said bracket portion also defines at least one small diameter hole for receiving a needle valve.

14. A ball holder as recited in claim 13, wherein said hoop portion and said bracket portion are molded together as a single, unitary piece.

15. A ball holder as recited in claim 6, wherein said arcuate cross-sectional shape extends greater than 180°.

16. A ball holder as recited in claim 15, wherein said arcuate cross-sectional shape includes upwardly-projecting ears.

17. A ball holder, comprising:

a hoop portion, defining a substantially circular opening for supporting a spherical ball; and a bracket portion for supporting said hoop portion in a substantially horizontal orientation on a substantially vertical support surface;

said hoop portion and bracket portion having a top surface, said top surface defining an elongated, horizontally-extending, arcuate cross-section recess for receiving an air pump.

18. A ball holder as recited in claim 17, wherein said arcuate recess extends greater than 180°.

19. A ball holder as recited in claim 18, wherein a portion of said arcuate recess is defined by upwardly-projecting ears.

20. A ball holder as recited in claim 19, wherein the top surface of said hoop portion defines diametrically opposed, tapered recesses for receiving a football in a horizontal orientation.

21. A ball holder as recited in claim 20, wherein said bracket portion has a rear mounting surface, which defines first and second flat areas for mounting said bracket to a flat surface; first and second recessed flat areas, recessed from said first and second flat areas, for mounting said bracket to a rectangular cross-section post; and an arcuate recess, lying between and recessed from said recessed flat areas, for mounting said bracket to a circular cross-section post.

* * * * *